US009815655B2

(12) United States Patent
Crapet et al.

(10) Patent No.: US 9,815,655 B2
(45) Date of Patent: Nov. 14, 2017

(54) REFILL DEVICE FOR DISPENSING ARTIFICIAL EYELASHES AND REFILL FOR SAID DEVICE

(71) Applicant: ALBEA SERVICES, Gennevilliers (FR)

(72) Inventors: Yann Crapet, Pontoise (FR); Osvaldo Uresti, Paris (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 15/079,188

(22) Filed: Mar. 24, 2016

(65) Prior Publication Data

US 2016/0280501 A1 Sep. 29, 2016

(30) Foreign Application Priority Data

Mar. 27, 2015 (FR) ..... 15 52609

(51) Int. Cl.

| | |
|---|---|
| ***A45D 40/30*** | (2006.01) |
| ***B65H 37/00*** | (2006.01) |
| ***A41G 5/02*** | (2006.01) |
| ***B65D 83/08*** | (2006.01) |

(52) U.S. Cl.

CPC ..... *B65H 37/005* (2013.01); *A41G 5/02* (2013.01); *B65D 83/087* (2013.01); *B65H 2701/1942* (2013.01)

(58) Field of Classification Search

CPC . A45D 44/00; A45D 2/48; A41G 5/02; B65H 35/002; B65H 2701/942; B65D 83/087

See application file for complete search history.

(56) References Cited

U.S. PATENT DOCUMENTS

| | | | | |
|---|---|---|---|---|
| 6,776,209 | B1 | 8/2004 | You | |
| 2012/0000957 | A1* | 1/2012 | Martinez | A41G 5/02 225/57 |
| 2014/0261514 | A1 | 9/2014 | Martins et al. | |

FOREIGN PATENT DOCUMENTS

| | | | |
|---|---|---|---|
| EP | 1834914 | A1 | 9/2007 |

OTHER PUBLICATIONS

French Application No. 1552609, Search Report, dated Nov. 6, 2015.

* cited by examiner

*Primary Examiner* — Rachel Steitz

(74) *Attorney, Agent, or Firm* — Banner & Witcoff, Ltd.

(57) ABSTRACT

A device for dispensing artificial eyelashes has a housing, a carrier strip to which a plurality of artificial eyelashes are fixed, and a movement mechanism capable of being actuated to cause the carrier strip to move in order to convey the artificial eyelashes towards an outside space of the housing. The device is equipped with a refill that is designed to be joined to the housing in a detachable manner. The refill has a plate, the carrier strip and the movement mechanism, the carrier strip and the movement mechanism being mounted on the plate. The invention further relates to a refill for such a device.

11 Claims, 5 Drawing Sheets

REFILL DEVICE FOR DISPENSING ARTIFICIAL EYELASHES AND REFILL FOR SAID DEVICE

CROSS REFERENCE TO RELATED APPLICATIONS

This application claims priority to French Application Serial No. 1552609 filed Mar. 27, 2015.

FIELD

The invention relates to the field of applying make-up, more particularly to the eyes, by adding artificial eyelashes to the natural eyelashes, which are more commonly referred to as 'false eyelashes'. The invention more specifically relates to a device for dispensing artificial eyelashes and a module comprising such a device.

Artificial eyelashes are generally used to increase the volume, the length or the lustre of natural eyelashes, or to give the face an aesthetic and decorative feature in the same way as a piece of jewelry, for example.

Artificial eyelashes are generally sold in the form of units, each unit comprising a fringe of eyelashes and a connecting strip holding the eyelashes together at their base, the other end of the eyelashes being free. These units can be sold in pairs in conventional boxes which have only changed slightly since they were first used, and have thus been overlooked in the significant innovations made in the field of make-up.

These boxes do not have any particular aesthetic or fun aspects for the consumer which may attract them to one product over another. Indeed, the companies selling these boxes only seek to distinguish them from other products by colour variations, and do not seek to give boxes for artificial eyelashes original features in terms of design or function which truly identify the brand of the eyelashes.

Furthermore, these boxes are not very practical as they only provide limited quantities of units of artificial eyelashes, typically a single pair, and this tends to increase the unit volume occupied by such a box as well as the price of the pair of units of eyelashes sold. These two factors tend to limit the purchase of large quantities of artificial eyelashes.

Artificial eyelash dispensers are also known that comprise a housing and a carrier strip to which the artificial eyelashes are attached. A movement mechanism inside the housing thus makes it possible to convey the eyelashes towards the outside of the housing. This solution makes it possible to store a large number of eyelashes. However, these dispensers have the drawback of not being reusable, since once all the eyelashes are used up, the eyelash dispenser becomes unusable.

SUMMARY

One of the problems addressed by the invention is that of allowing the user to reuse the dispensing device at least in part after the eyelashes contained therein have been used up.

This problem is solved within the context of the present invention by a device for dispensing artificial eyelashes, comprising a housing, a carrier strip to which a plurality of artificial eyelashes are fixed, and a movement mechanism capable of being actuated to cause the carrier strip to move in order to convey the artificial eyelashes towards an outside space of the housing, said device being equipped with a refill that is designed to be joined to the housing in a detachable manner, said refill comprising a plate, said carrier strip and the movement mechanism, said carrier strip and the movement mechanism being mounted on said plate.

In this way, a user who has used up all of the artificial eyelashes in the device can just replace the refill and retain the housing. The user may thus reuse at least part of the device for dispensing artificial eyelashes.

Advantageously, but optionally, the invention may also be supplemented with all or some of the following features:

- said housing is equipped with a dispensing opening,
- said movement mechanism is capable of being actuated to cause the strip to move in order to convey the artificial eyelashes towards the dispensing opening and to allow the artificial eyelashes to exit through the dispensing opening,
- said plate is designed to be rigidly connected to the housing by screwing,
- said plate is designed to be rigidly connected to the housing by elastic deformation and/or by snapping in,
- the housing comprises a base and a cover that are designed to be joined to one another in a detachable manner,
- said plate is designed to be mounted in a detachable manner relative to the base and/or to the cover,
- said plate is equipped with a rotatable bearing for guiding the strip,
- said plate is designed to prevent the strip from moving in the opposite direction to that of the movement of the strip that allows the eyelashes to exit,
- said plate is equipped with a guide rib for guiding the carrier strip,
- the housing and the plate are two separate elements,
- the mechanism for moving the carrier strip comprises:
  - a spool that is rotatably mounted relative to the housing,
  - an actuating means for rotating the spool, allowing the carrier strip to be wound around the spool, winding the carrier strip around the spool causing the carrier strip to move in order to dispense the eyelashes.

The invention also relates to a refill for such a device.

BRIEF DESCRIPTION OF THE DRAWINGS

Other features, aims and advantages of the invention will become clearer from the following description which is given purely by way of illustrative and non-limiting example and should be read with reference to the following drawings, in which.

DETAILED DESCRIPTION

Figure 1A:
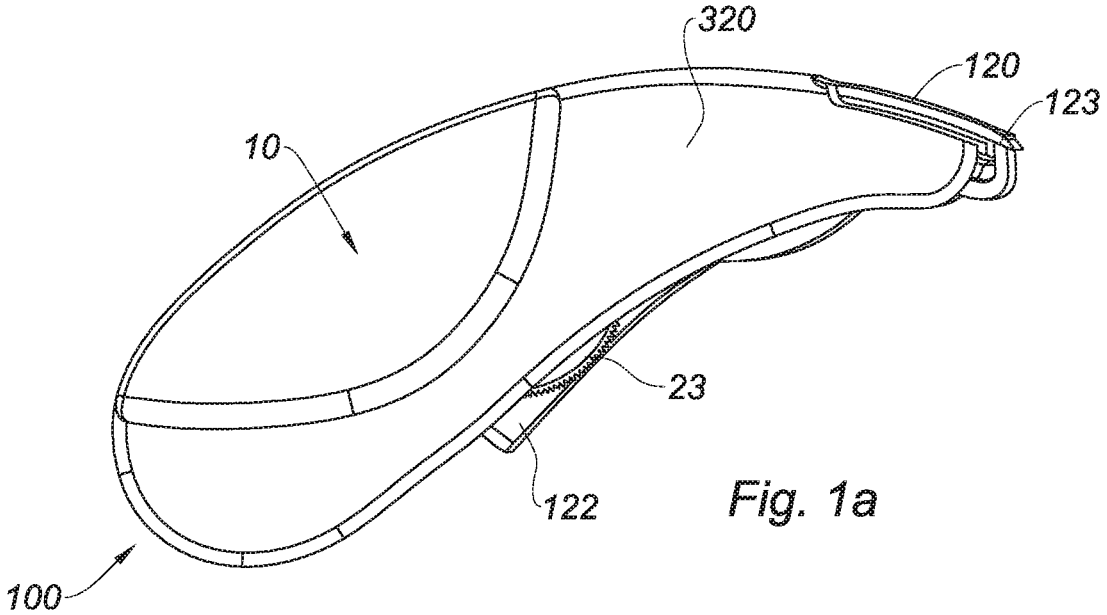
FIG. 1*a* is a front view of a device for dispensing artificial eyelashes according to an embodiment of the invention, shown in a first configuration.
Figure 1B:
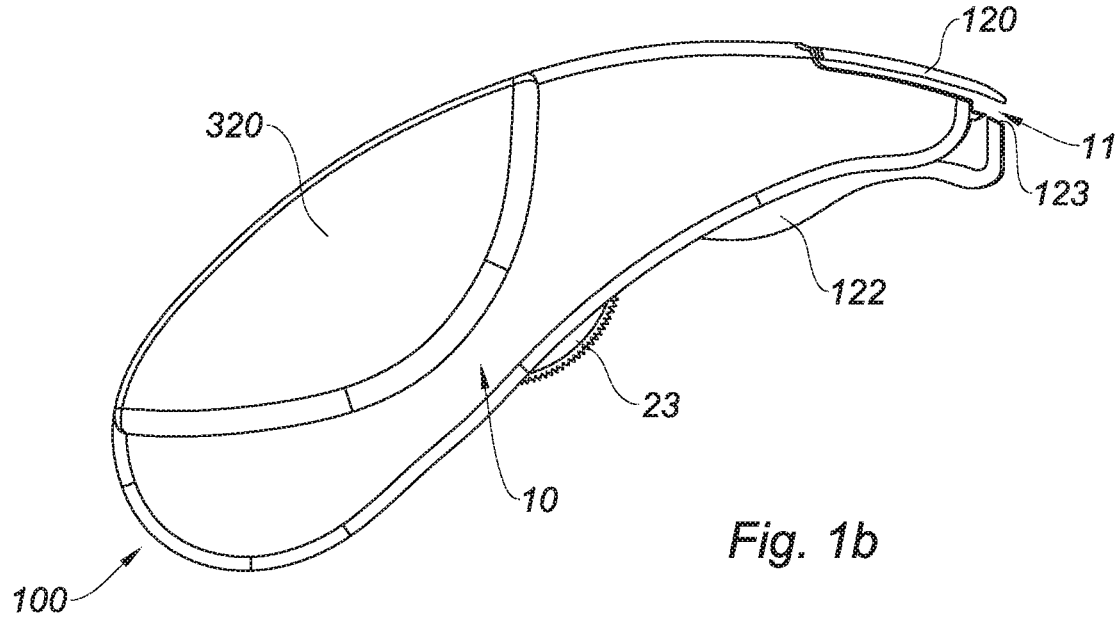
FIG. 1*b* is a front view of the device from FIG. 1*a*, shown in a second configuration.
Figure 2:
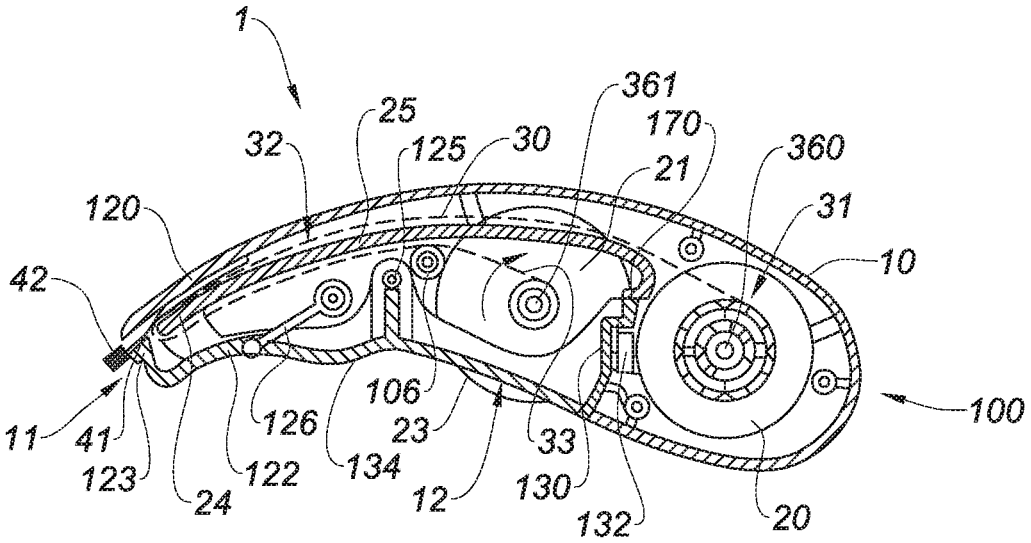
FIG. 2 is a longitudinal section through the device from FIG. 1*b*.
Figure 3:
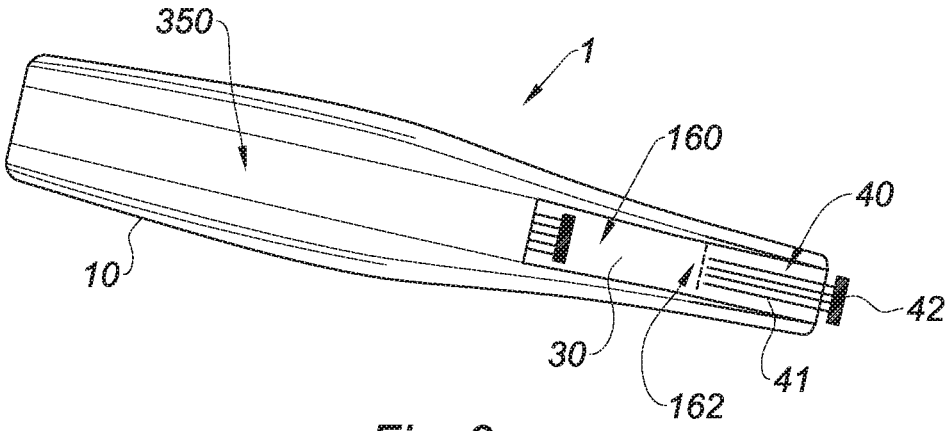
FIG. 3 is a plan view of the device, according to the same embodiment.

As shown in FIGS. 1 to 3, the invention relates to a device 1 for dispensing artificial eyelashes.

Said device 1 comprises a housing 10, preferably made of a plastics material such as polypropylene (PP), polyethylene (PE), acrylonitrile butadiene styrene (ABS), styrene acrylonitrile (SAN) or polyethylene terephthalate (PET), polyethylene terephthalate glycol-modified (PETG), Surlyn® resin or polyoxymethylene (POM). The housing 10 may also be made of metal, such as aluminium, Zamak, etc.

The housing 10 may be opaque, or by contrast may be transparent, so that the elements that it contains can be seen, in particular at least partially transparent, as will be expanded upon in the following.

Here, the housing 10 is formed by a peripheral contour 350 and two side walls 310, 320 that define an interior of the housing. Said peripheral contour 350 connects the two side walls 310, 320, which are substantially planar, are the same shape and are in parallel with one another. One of the side walls, referred to as the bottom 310, and the peripheral contour 350 are advantageously formed in one piece, said peripheral contour 350 being arranged over a periphery of said bottom 310. The bottom 310 and the peripheral contour 350 form a base. The other of the side walls, referred to as the cover 320, is capable of acting as a cover for the base.

Figure 6:
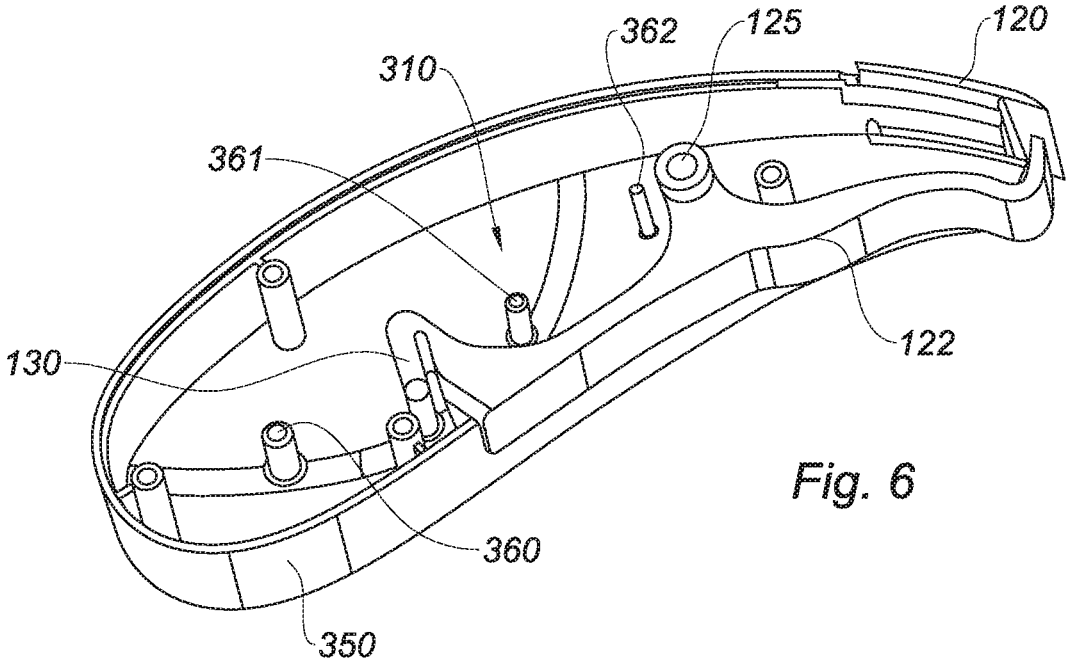
FIG. 6 is a perspective view of a base of a housing of the dispensing device, according to the same embodiment.
Figure 9:
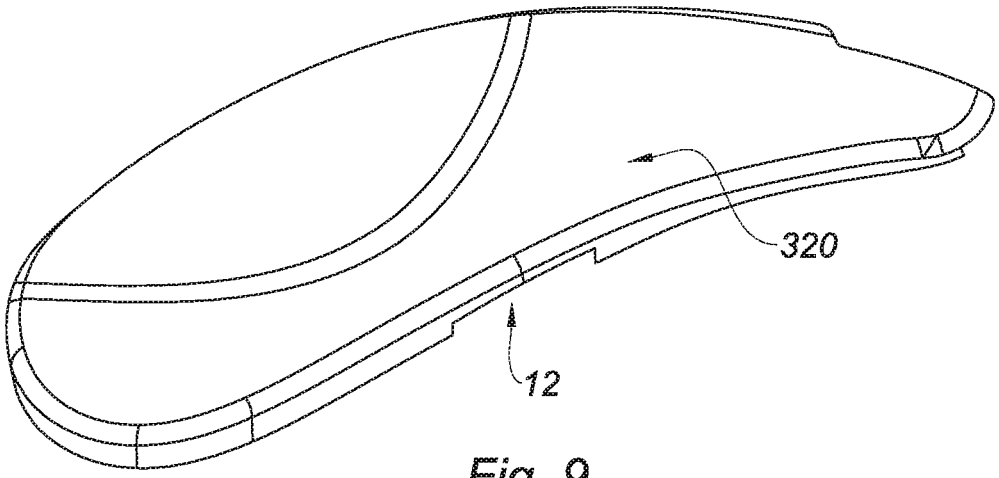
FIG. 9 is a perspective view of a cover of said housing, according to the same embodiment.

The base and the cover 320, shown in FIGS. 6 and 9, respectively, are designed to be joined together in an undefined manner, for example by screwing, by snapping in or by elastic deformation. In other words, said cover 320 and said base are designed to be joined together in a detachable manner.

According to the invention, the device 1 comprises a refill which can be detached from the housing 10. Said refill is equipped with a plate 102, as shown in FIGS. 4, 5, 7 and 8. In other words, said plate 102 is designed to be rigidly connected to the housing 10 in an undefined manner, for example by screwing, by snapping in or by elastic deformation. Again in other words, said plate 102 is designed to be removed from the housing 10, in particular when the base and the cover 320 are taken apart.

According to the invention, the fact that the plate 102 can be detached, in particular from the housing 10, makes it possible to refill the device 1 without having to replace the entirety thereof.

The housing 10 and the plate 102 are separate elements in this case. In other words, the plate 102 is separate from the housing 10.

Said plate 102 is a support that is for example designed to be in contact with part of the base inside the housing 10. Said plate 102 may be equipped with a substantially planar part 107. It is also noted that the plate 102 has dimensions which allow the plate to be positioned within said base, in particular within a space defined by said peripheral contour 350.

Alternatively, in another embodiment which is not shown in the drawings, said plate 102 may be rigidly connected to the cover 320.

It is also noted that said plate 102 may be made of an identical material to that of the housing 10, for example of a plastics material or a metal. Alternatively, said plate 102 may be made of another material.

As shown in FIGS. 1*b* and 2, the housing 10 is provided with a dispensing opening 11, through which the eyelashes 41 exit in order to be used by a user. Said device 1 also comprises, inside the housing 10, a carrier strip 30, shown by a dashed line in FIG. 8, to which the eyelashes 41 are fixed, and a movement mechanism capable of being actuated to cause the carrier strip 30 to move in order to convey the eyelashes 41 towards the dispensing opening 11. Said device 1 is thus configured to allow artificial eyelashes 41 to exit through the dispensing opening 11 as a result of the movement of the carrier strip 30.

According to the invention, said carrier strip 30 and the movement mechanism form part of the refill and are mounted on said plate 102.

On the carrier strip 30, the eyelashes 41 are preferably grouped together in the form of units 40 of eyelashes, as shown in FIG. 3.

The fixing of the units 40 of eyelashes to the carrier strip 30 is preferably ensured by an adhesive coating on the carrier strip 30, the coating having properties suitable for allowing the units 40 to be removed without damaging the eyelashes 41.

Each unit 40 of eyelashes may comprise a fringe of eyelashes 41 and a connecting strip 42. The eyelashes 41 are interconnected at one end, preferably their base, by the connecting strip 42, the other end being free.

The artificial eyelashes 41 and the connecting strip 42 are made of synthetic fibres, typically polybutylene terephthalate (PBT) and PVC, and are rigidly connected to the connecting strip 42 by any known method. They may for example be adhered to or formed in one piece with the connecting strip 42. They may also be sewn to the connecting strip 42 or welded to said strip 42.

Advantageously, the carrier strip 30 has a plurality of separate adhesive regions, said regions being for example covered with an adhesive coating, the remainder of the carrier strip 30 not being adhesive.

The units 40 of eyelashes are preferably fixed to the carrier strip 30 such that the eyelashes are oriented in parallel with the longitudinal direction of the carrier strip 30, the connecting strip 42 thus being transverse to this direction. In a variant, the eyelashes 41 may be oriented transversely, in particular orthogonally.

Furthermore, the units 40 of eyelashes are preferably regularly distributed over the carrier strip 30 such that they are spaced apart by a constant interval between two consecutive units. Typically, this interval may be between 5 and 20 mm.

Typically, the eyelashes 41 have a length L of between 8 and 15 mm, preferably equal to 10 mm.

The units 40 of eyelashes themselves have a width 1 of between 3 and 10 mm, preferably of between 4 and 5 mm. This width is less than the units of eyelashes that are conventionally commercially available. It is thus necessary to apply a plurality of units 40 of eyelashes to the eyelid to cover the total width of the user's eyelid.

In the case of eyelashes that are oriented in parallel with the carrier strip 30, the reduction in the width 1 of the units 40 of eyelashes makes it possible to reduce the width of the carrier strip 30 to which the units are fixed, and as a result the volume occupied by the dispensing device 1.

As seen in FIGS. 2, 4, 5, 7 and 8, the movement mechanism comprises a reel 20, which is rotatably mounted relative to the plate 102. A first longitudinal end of the carrier strip 30 is fixed to the reel 20, and a part 31 of the carrier strip 30 to which the units of artificial eyelashes to be dispensed are fixed is wound around the reel 20. The reel 20 is therefore positioned upstream of the dispensing opening 11, and may even form the starting point of the path of the carrier strip 30.

The part 31 of the carrier strip 30 that is wound around the reel 20 forms a reserve of units of eyelashes 40. More particularly, the dimensions of the device 1 may allow several meters of carrier strip 30 to be wound, for example between 0.5 and 2 meters of strip, thereby allowing between 20 and 180 units of artificial eyelashes to be stored. This allows a user to have approximately 10 to 30 days' worth of artificial eyelashes.

The length of the strip to be wound around the reel 20, as well as the diameter of the circular cross section thereof, have to be adapted so that winding the carrier strip 30 around the reel does not alter the radius of curvature of the eyelashes too significantly once dispensed.

For example, if the diameter of the circular cross section of the reel 20 is too low, the eyelashes on the part of the strip closest to the outer surface of the reel will have too high a radius of curvature. Thus, the diameter of the circular cross section of the reel 20 is between 5 and 12 mm.

Moreover, winding the carrier strip 30 forms a cylinder around the reel 20, of which the diameter increases progressively with the length of the wound carrier strip 30. If the length of the wound carrier strip 30 is too great, the diameter of the cylinder thus formed will be high and the radius of curvature of the eyelashes fixed to the carrier strip 30 at the periphery of the winding will be too low.

The winding length of the carrier strip 30 that is indicated above takes this effect into account. The diameter of the cross section of the cylinder formed by the carrier strip 30 wound around the reel 20 may be 30 mm at the most. The dispensing device 1 thus allows a considerable number of units of artificial eyelashes 40 to be stored, unlike the conventional boxes, and indeed in a highly compact manner, owing to the carrier strip 30 being wound around the reel 20.

Figure 8:
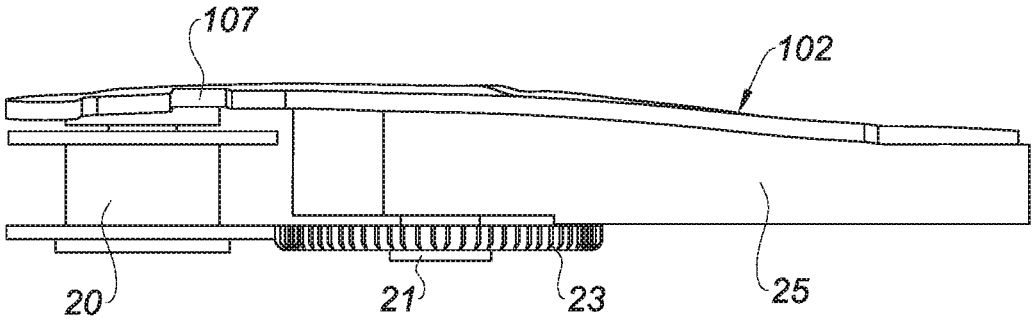
FIG. 8 is a view in profile of the refill, according to the same embodiment.

As shown in FIG. 8, the reel 20 is in the form of a cylinder having a circular cross section, the cylinder being movable in rotation about its axis of revolution and having a length that is greater than or equal to the width of the carrier strip 30. This allows the carrier strip 30 to rest correctly on the outer surface of the cylinder 20.

It is noted that the reel 20 may be made of the same material as the plate 102.

In this case, the system for moving the carrier strip 30 further comprises a spool 21, which is rotatably mounted relative to the plate. The spool 21 is downstream of the dispensing opening 11 on the path of the strip 30.

The second longitudinal end of the carrier strip 30 that is not fixed to the reel is fixed to the spool 21, and a part 33 of the carrier strip 30 from which the units 40 of eyelashes have been removed is wound around the spool 21.

In a similar manner to the reel 20, the spool 21 is in the shape of a cylinder having a circular cross section, the cylinder being movable in rotation relative to the plate 102 and having a length that is greater than or equal to the width of the carrier strip 30. This allows the carrier strip 30 to rest correctly on the outer surface of the spool 21. Advantageously, the spool 21 may be made of the same material as the plate 102.

The reel 20 and/or the spool 21 may comprise lateral flanges allowing said carrier strip 30 to be guided.

As can be seen in particular in FIG. 6, the housing 10 advantageously comprises positioning pins 360 and 361. Said positioning pins 360 and 361 are for example formed in one piece with the base of the housing 10 and are designed to allow the plate 102 to be positioned within the housing 10.

Figure 4:
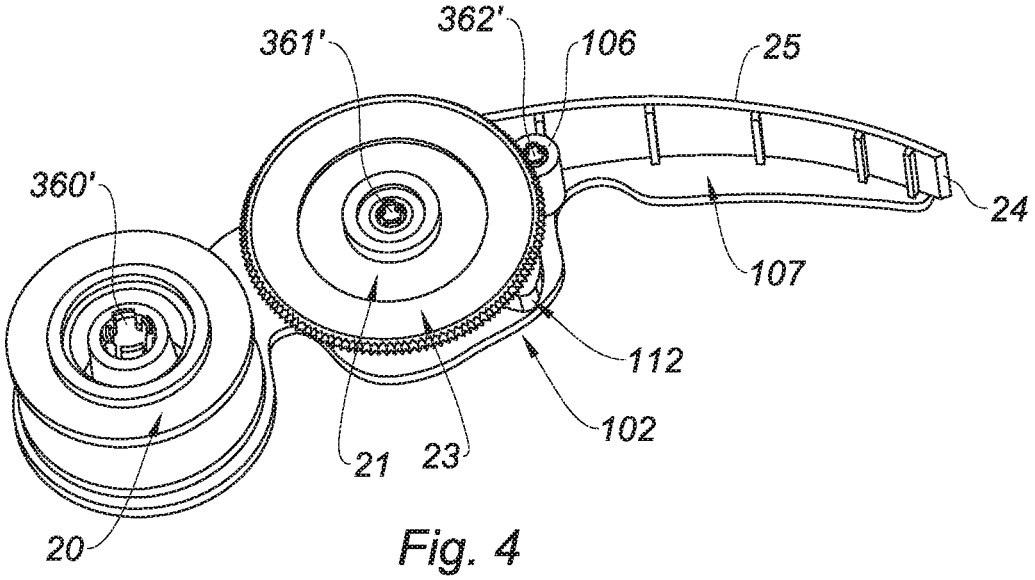
FIG. 4 is a perspective view of a refill for the dispensing device, according to the same embodiment.
Figure 5:
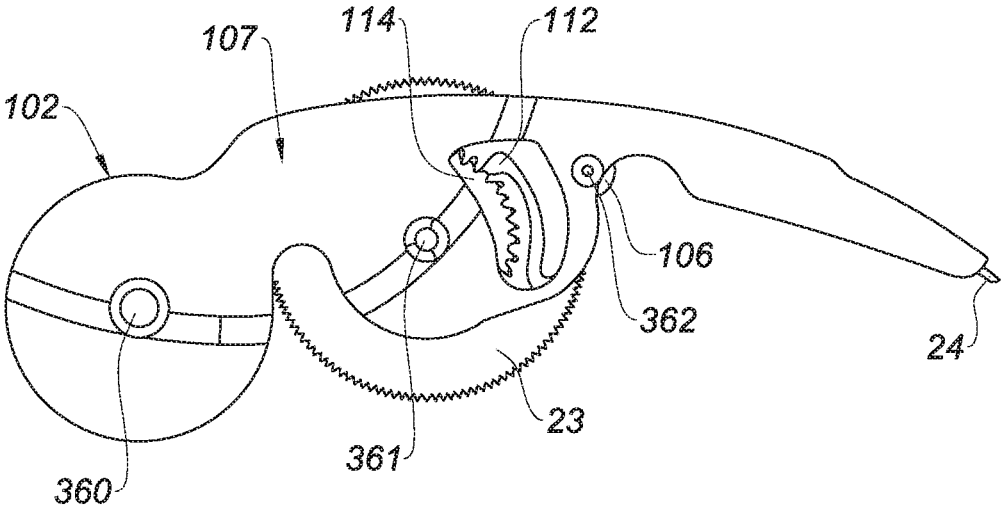
FIG. 5 is a front view of the refill, according to the same embodiment.

With reference to FIG. 4, it is noted that said plate 102 is equipped in this case with at least two articulation shafts 360' and 361' formed in one piece with the plate 102. Said articulation shafts 360' and 361' are hollow, for example, so as to cooperate with said positioning pins 360 and 361, respectively. In other words, said articulation shafts 360' and 361' are configured to receive the positioning pins 360 and 361, respectively.

Advantageously, the cooperation of the articulation shafts 360' and 361' with the positioning pins 360, 361 makes it possible to rigidly connect the plate 102 to the base, and therefore to the housing 10, at least in part. In other words, once the plate 102 has been arranged in the housing 10, the positioning pins 360 and 361 are advantageously designed to be arranged inside the articulation shafts 360' and 361' so as to immobilise the plate 102 at least in part.

It is noted that said articulation shafts 360', 361' advantageously extend orthogonally to said substantially planar part 107 of the plate 102. Said shafts are designed to be arranged in parallel with the positioning pins 360, 361. It is also noted that the positioning pins 360 and 361 for example have an outer diameter that is substantially equal to an inner diameter of the articulation shafts 360', 361'.

The reel 20 is designed to be mounted so as to rotate about the articulation shaft 360' of the plate 102. The spool 21 itself is designed to be rotatably mounted relative to the articulation shaft 361' of the plate 102. It should be noted that said articulation shafts 360' and 361' each have a length that is substantially greater than or equal to the length of the reel 20 and that of the spool 21, respectively.

Figure 7:
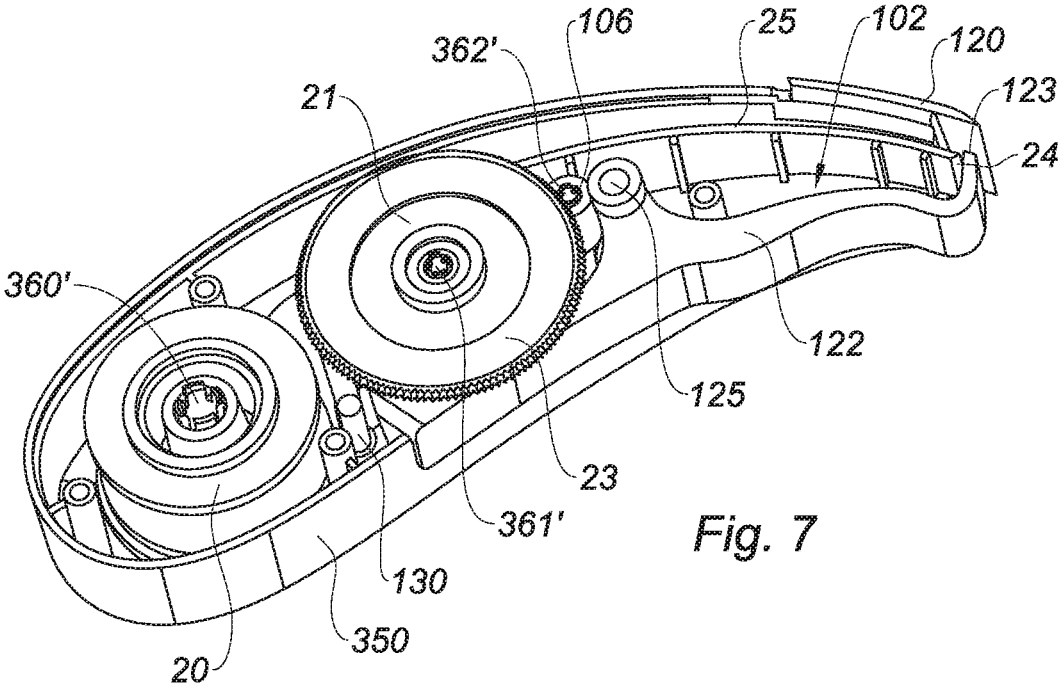
FIG. 7 is a perspective view of the base of said housing comprising the refill, according to the same embodiment.

As shown in FIGS. 4 and 7, each of the articulation shafts 360' and 361' are advantageously equipped, in the region of a free end, with retaining lugs designed to allow the reel 20 and the spool 21 to be retained on said articulation shafts 360' and 361', respectively, and therefore on the plate 102.

As shown in FIG. 2, an intermediate part 32 of the carrier strip 30, located between the part 31 wound around the reel 20 and the part 33 wound around the spool 21, passes close to the dispensing opening 11.

This part 32 is supported on a deflecting element 24, which is in this case in the form of an end of a rib 25 for guiding said carrier strip 30. Said guide rib 25 is advantageously formed in one piece with said plate 102 and is rigidly connected thereto. Said deflecting element 24 is designed to be arranged close to the dispensing opening 11, that is to say at a distance from the dispensing opening 11 that is less than the length of an eyelash. In FIG. 8, a single unit of eyelashes has been shown for the sake of simplicity.

The carrier strip 30 is tensioned by the deflecting element 24, and passes around it while changing direction, in its path between the reel 20 and the spool 21.

The position of the deflecting element 24 and the diameter thereof are adapted so that, when the carrier strip 30 passes around the element 24, the unit 40 of eyelashes is removed in part from the carrier strip 30 and exits the device 1 through the dispensing opening 11.

For example, a direction of the carrier strip 30 upstream of the deflecting element 24 and a direction of the carrier strip downstream of the deflecting element 24 are selected to promote this removal.

The radius of the deflecting element 24 is selected such that its outer surface has a radius of curvature of between 0.5 and 40 mm, so that when the strip passes around the deflecting element while resting on this outer surface, it adopts the same radius of curvature.

Furthermore, the units 40 of eyelashes are arranged on the strip such that the natural curvature of the eyelashes is opposite to the curvature adopted by the carrier strip 30 when it passes around the deflecting element 24.

Thus, when the carrier strip 30 reaches the deflecting element 24 and changes direction by pivoting about said element, the end of the unit 40 located downstream is removed from the carrier strip 30, and exits through the dispensing opening 11.

The units 40 to be dispensed are preferably arranged on the carrier strip 30 such that, when the carrier strip 30 is moved towards the dispensing opening 11, the connecting strips 42 of the eyelashes 41 are conveyed towards the dispensing opening 11 first.

In this way, it is the connecting strip 42 that is removed from the carrier strip 30 and that exits the device 1 through the dispensing opening 11. The free end of the eyelashes, however, remains bonded to the carrier strip 30.

When the carrier strip 30 is in this position, the user can apply adhesive to the connecting strip 42 before manually removing the unit from the device 1. During this step of applying adhesive, the unit 40 is therefore held on the carrier strip 30 by the free end of the eyelashes 41, and the user does not need to hold the eyelashes 41 in their hand. This results in a lower risk of the artificial eyelashes 41 being damaged while having adhesive applied thereto.

Moreover, in order to make it easier to handle the unit 40 of eyelashes for the purposes of applying adhesive thereto and of applying them, walls 120, 122 of the housing 10 located on either side of the dispensing opening 11 made in the housing 10 are preferably in the form of tweezers, as will be expanded upon in the following.

In operation, the part 32 of the carrier strip 30 located downstream of the deflecting element 24 no longer holds any units of eyelashes because they have been removed through the dispensing opening. This part 32 of the carrier strip 30 is conveyed as far as the spool 21.

In this case, the mechanism for moving the carrier strip 30 further comprises actuating means 23 for rotating the spool 21, allowing the carrier strip 30 to be wound around the spool 21, winding the carrier strip 30 around the spool 21 causing the carrier strip 30 to move in order to dispense the eyelashes 41, as already mentioned.

Advantageously, the housing 10 comprises an opening 12 and the actuating means 23 comprises a scroll wheel which can be operated via said opening 12.

Said device 1 may be configured such that manual actuation of the scroll wheel 23 in a direction towards the dispensing opening 11 from an opposite part 100 of the housing 10 causes the carrier strip 30 to move in order to dispense the eyelashes 41. In other words, in FIG. 2, in which the dispensing opening 11 is located on the left, the scroll wheel 23 has to be actuated in the clockwise direction in order to make it possible to unwind the carrier strip 30. It is unwound by a movement that is intuitive to the user and corresponds to a movement that pushes the eyelashes.

As shown in FIGS. 1*b* and 7, the scroll wheel 23 may comprise a knurled wheel which projects out of the housing 10 through the opening 12. The spool 21 is, for example, coaxial with and rigidly connected to said scroll wheel 23. In this way, the carrier strip 30 can be moved forwards by rotating the scroll wheel 23.

The knurled wheel of the scroll wheel 23 advantageously has an outer peripheral surface which is provided with ridges. Said peripheral surface is intended to be manipulated by the user in order to actuate the scroll wheel 23. As stated above, the knurled wheel is arranged to project out of the housing 10 through the opening 11, in particular when the tweezers are open. In this way, the user can move the eyelashes 41 forwards towards the dispensing opening 11 by manipulating the scroll wheel 23.

More specifically, the rotation of the scroll wheel 23 causes the spool 21 to rotate and the carrier strip 30 to be wound around the spool. This winding causes the part of the carrier strip 30 extending between the reel 20 and the spool 21 to be moved, and therefore causes the units of eyelashes 40 to be conveyed towards the dispensing opening, accompanied by the removal of the eyelashes in the region of the above-described dispensing opening. This movement causes the carrier strip 30 to be unwound from the reel 20.

Said plate 102 may further be equipped with a rotatable bearing 106 designed to allow the strip 30 to be guided. Said rotatable bearing 106 can rotate freely, for example, about an articulation shaft 362', which is in particular moulded on the remainder of said plate 102. Said articulation shaft 362' of the plate 102 may itself be hollow, in order to define a receiving portion that cooperates with a positioning pin 362 that is formed in one piece with the base of the housing 10. Advantageously, said positioning pin 362, in the same way as the other positioning pins 360 and 361, is oriented in a direction orthogonal to the side wall 310 and parallel to the articulation shaft 362.

As is the case for the spool 20 and the reel 21, said articulation shaft 362' may advantageously be equipped at its free end with retaining lugs for retaining the rotatable bearing 106.

A mechanism for blocking the scroll wheel 23 in one direction of rotation can also be provided such that the user can only rotate said wheel in the direction in which the spool 21 unwinds. Said plate 102 is thus equipped with a flexible arm 112 acting as an anti-reverse lever by cooperating with a toothed wheel 114 which is coaxial with and rigidly connected to the spool 21, thereby allowing the plate to fulfill the function of blocking the movement of the carrier strip 30 in an undesired direction.

As already stated, the walls 120, 122 which are located on either side of the dispensing opening 11 may be designed to press against each other in the manner of tweezers, in order to hold one or more of said eyelashes 41 between said walls 120, 122.

According to an aspect of the invention, as shown in FIG. 6, one 120 of said walls is fixed and the other 122, referred to as the movable arm of the tweezers, is articulated, in particular by pivoting about a shaft 125 relative to the remainder of the housing 10.

Here, the fixed wall 120 is formed by a portion of the peripheral contour 350 and the movable arm 122 is located in a portion of the peripheral contour 350 opposite the fixed wall 120. In other words, the fixed wall 120 and the movable arm 122 are substantially opposite one another.

Therefore, in order to block the eyelashes 41, the user actuates the movable arm 122 to catch the eyelashes against the fixed wall 120. Said movable arm 122 may comprise, at its distal end, a lip 123 which allows planar contact against the fixed wall 120 so as to improve handling of the eyelashes 41.

Advantageously, as shown in FIG. 1*a*, the movable arm 122 may be designed to prevent eyelashes 41 from being conveyed towards the dispensing opening 11 when the tweezers are closed. For this purpose, when the movable arm 122 is in a closed position, it may be designed to conceal one side of the knurled wheel. Said side of the knurled wheel and part of the movable arm 122 are therefore opposite one another. In this configuration, the scroll wheel 23 is thus difficult to manipulate since the ridges on the knurled wheel which are used to manipulate this wheel are more difficult to access.

In other words, in the closed position, the movable arm 122 laterally covers one side of the scroll wheel 23 such that the knurled wheel no longer projects out of the housing 10. It thus becomes difficult for the user to manipulate the scroll wheel 23. In particular, the manipulation of the outer peripheral surface, in the region of which the ridges of the knurled wheel are located, is obstructed by the presence of part of the movable arm 122 in the vicinity.

Conversely, as shown in FIG. 1*b*, in the open position, the same part of the movable arm 122 is retracted into the housing 10.

As shown in FIG. 2, said device 1 may further comprise a leaf spring 126 that exerts force on said movable arm 122 to hold it in an open position of the tweezers. Said leaf spring 126 exerts its effect for example on a part of the movable arm 122 that is between its articulation shaft 125 and its distal end 123. Said leaf spring 126 is for example positioned on said plate 102 and is rotatably mounted relative thereto.

Said movable arm 122 may further be designed to be held in a latched manner on the housing 10 in a closed position of said tweezers. In this case, said movable arm 122 comprises one or more flexible tabs 130 for this purpose that are intended to cooperate with a complementary shape that is rigidly connected to the housing 10. Said flexible tabs are located at one end of the movable arm 122 opposite the end on which said leaf spring acts. In order to release the tweezers to allow them to return to an open position, the user presses on the movable arm 122 on the part thereof located between said articulation shaft 125 and said flexible tabs 130.

Said plate 102 may comprise a stop 170 for positioning said flexible tabs 130 in the open position of the tweezers. Said positioning stop may comprise a part, in particular an end of the guide rib 25 that is opposite the end located adjacent to the dispensing opening 11.

Said spool 21 may be located in the housing 10 at the end of the part of said movable arm 122 that is between its articulation shaft 125 and the end opposite the distal end 123, that is to say, in this case, the end comprising the flexible latching tabs 130.

Said movable arm 122 may further comprise a handling protrusion 134 for moving from the open position to the closed position. In this case, the protrusion is located between the articulation shaft 125 of said movable arm and its distal end 123, in particular between said articulation shaft 125 of said movable arm and an actuating region of said leaf spring 126.

As stated above, it is noted that movement from the closed position to the open position of the tweezers is caused by a user action on the part of the movable arm 122 located between the shaft 125 and the flexible tab 130. Rotation in the opposite direction of the movable arm 122, from an open position to a closed position, is caused by a user action on the part of the movable arm 122 located between the shaft 125 and the lip 123.

According to another aspect, shown in FIG. 3, said housing 10 may comprise a window 160 for viewing the carrier strip 30 in the vicinity of the dispensing opening 11, in particular produced by means of a transparent part of the housing, as stated above. Said window 160 may advantageously have a marker 162 for positioning one or more of said eyelashes 41. The positioning of said marker is selected, for example, in order to establish the preferred immobilisation position of the eyelashes by the above-mentioned tweezers.

Moreover, referring again to FIG. 2, it is noted that, in the position of the carrier strip 30 in which the connecting strip 42 is detached from the carrier strip 30 and in which the free end of the eyelashes 41 remains adhered to the carrier strip 30, an end of the eyelashes that is contiguous with the connecting strip 42 is advantageously in contact with or resting on the movable arm 122, in this case on the lip 123. In this way, when the eyelashes 41 are in this position, the closure of the tweezers and therefore the lip 123 coming closer to and then contacting the fixed wall 120 assists or completes the removal of the eyelashes 41. In particular, the contact between the movable arm 122 and the fixed wall 120, the eyelashes 41 being held therebetween, may cause localised deformation by flattening the eyelashes 41 which were initially curved over their entire length. This deformation may contribute to the removal of the eyelashes 41 from the carrier strip 30. The initial contact between the eyelashes 41 and the movable arm 122 may take place in the open position of the tweezers or at a later stage of the closing movement thereof.

One or more devices may further be sold as part of a complete kit for applying artificial eyelashes, the kit further comprising a bottle of adhesive for applying adhesive to the connecting strip of the units of eyelashes, and a bottle of dissolving solution for dissolving said adhesive.

According to another aspect of the invention, the carrier strip 30 may alternatively be a thread.

The invention claimed is:

1. Device for dispensing artificial eyelashes, comprising a housing, a carrier strip to which a plurality of artificial eyelashes are fixed, and a movement mechanism capable of being actuated to cause the carrier strip to move in order to convey the artificial eyelashes towards an outside space of the housing, said device being equipped with a refill that is designed to be joined to the housing in a detachable manner, said refill comprising a plate, said carrier strip and the movement mechanism, said carrier strip and the movement mechanism being mounted on said plate, wherein the movement mechanism comprises a reel and a spool which are rotatably mounted relative to the plate, a first longitudinal end of the carrier strip being fixed to the reel and a part of the carrier strip to which the artificial eyelashes to be dispensed are fixed being wound around the reel, a second longitudinal end of the carrier strip being fixed to the spool and a part of the carrier strip from which the artificial eyelashes have been removed being wound around the spool.

2. Device according to claim 1, wherein the housing comprises a base and a cover that are designed to be joined to one another in a detachable manner.

3. Device according to claim 2, wherein said plate is designed to be mounted in a detachable manner relative to the base and/or to the cover.

4. Device according to claim 1, wherein said plate is designed to be rigidly connected to the housing by screwing.

5. Device according to claim 1, wherein said plate is designed to be rigidly connected to the housing by elastic deformation and/or by snapping in.

6. Device according to claim 1, wherein said plate is equipped with a rotatable bearing for guiding the carrier strip.

7. Device according to claim 1, wherein said plate is designed to prevent the carrier strip from moving in the opposite direction to that of the movement of the carrier strip that allows the eyelashes to exit.

8. Device according to claim 1, wherein said plate is equipped with a guide rib for guiding the carrier strip.

9. Device according to claim 1, wherein said housing is equipped with a dispensing opening, said movement mechanism being capable of being actuated to cause the carrier strip to move in order to convey the artificial eyelashes towards the dispensing opening and to allow the artificial eyelashes to exit through the dispensing opening.

10. Device according to claim 1, wherein the mechanism for moving the carrier strip comprises:

a spool that is rotatably mounted relative to the housing, an actuating means for rotating the spool, allowing the carrier strip to be wound around the spool, winding the carrier strip around the spool causing the carrier strip to move in order to dispense the eyelashes.

11. A refill for a device for dispensing artificial eyelashes, said device comprising a housing, said refill designed to be joined to the housing in a detachable manner, said refill comprising a plate, a carrier strip to which a plurality of artificial eyelashes are fixed, and a movement mechanism configured to cause the carrier strip to move in order to convey the artificial eyelashes towards an outside space when the refill is joined to the housing, said carrier strip and movement mechanism being mounted on said plate, wherein the movement mechanism comprises a reel and a spool which are rotatably mounted relative to the plate, a first longitudinal end of the carrier strip being fixed to the reel and a part of the carrier strip to which the artificial eyelashes to be dispensed are fixed being wound around the reel, a second longitudinal end of the carrier strip being fixed to the spool and a part of the carrier strip from which the artificial eyelashes have been removed being wound around the spool.

* * * * *